US010063958B2

(12) United States Patent
Jentz et al.

(10) Patent No.: US 10,063,958 B2
(45) Date of Patent: Aug. 28, 2018

(54) EARPIECE ATTACHMENT DEVICES

(71) Applicant: Microsoft Technology Licensing, LLC, Redmond, WA (US)

(72) Inventors: Lorenz Henric Jentz, Seattle, WA (US); Philip Bryan, Bellevue, WA (US); Monika Romana Wolf, Seattle, WA (US); Kenneth Dennis Jasinski, Seattle, WA (US); Kory Gunnerson, Cincinnati, OH (US); Emron J. Henry, Seattle, WA (US); Karl William Vanderbeek, Cincinnati, OH (US); Richard James Wattles, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 14/536,553

(22) Filed: Nov. 7, 2014

(65) Prior Publication Data

US 2016/0134957 A1 May 12, 2016

(51) Int. Cl.
*H04R 1/10* (2006.01)

(52) U.S. Cl.
CPC ..... *H04R 1/105* (2013.01); *H04R 1/1008* (2013.01); *H04R 2460/09* (2013.01)

(58) Field of Classification Search
CPC ..... H04R 1/105; H04R 1/1008; H04R 2201/107; H04R 2225/021; H04R 25/656;
(Continued)

(56) References Cited

U.S. PATENT DOCUMENTS 4,451,709 A 5/1984 Waxman
4,773,095 A 9/1988 Zwicker et al.
(Continued)

FOREIGN PATENT DOCUMENTS

CN 201478648 U 5/2015
EP 1843627 A1 10/2007
(Continued)

OTHER PUBLICATIONS

"KSC75 Ear Clip Headphones," Published on Nov. 6, 2011, Available at: http://www.koss.com/en/products/headphones/ear-clip-headphones/KSC75_KSC75_Ear_Clip_Headphones.
(Continued)

*Primary Examiner* — Davetta W Goins
*Assistant Examiner* — Phylesha Dabney
(74) *Attorney, Agent, or Firm* — Ray Quinney & Nebeker, P.C.; Thomas M. Hardman; Miia Sula

(57) ABSTRACT

Devices for attaching earpiece to a user's ear are described herein. In one embodiment, an earpiece that is removably attachable to an ear of a user can include a housing that has a proximal end portion and a distal end portion. A transducer may be positioned, for example, at the proximal portion of the housing, and a retention member can be elastically coupled to the distal portion of the housing. The retention member and the housing can be configured to compress a portion of the user's ear therebetween in a manner that positions the proximal end portion of the housing in a vestibule of the ear adjacent an entrance to the auditory canal of the user's ear when the earpiece is attached to the user's ear.

12 Claims, 13 Drawing Sheets

(58) Field of Classification Search
CPC ..... H04R 1/10; H04R 1/1016; H04R 1/1058; H04R 1/1066; H04R 1/1091; H04R 2201/109; H04R 2225/025; H04R 2225/63; H04R 2460/09; H04R 2460/17; H04R 25/652; H04R 25/658; H04R 25/07
USPC ..... 381/370, 371, 374, 381; 379/433.01, 379/430; 455/569.1
See application file for complete search history.

(56) References Cited

U.S. PATENT DOCUMENTS

| | | | | |
|---|---|---|---|---|
| 4,902,120 | A | 2/1990 | Weyer | |
| 4,904,078 | A | 2/1990 | Gorike | |
| 5,253,300 | A | 10/1993 | Knapp | |
| 5,903,644 | A * | 5/1999 | Scheider | H04M 1/05 379/430 |
| 5,949,583 | A | 9/1999 | Rallison et al. | |
| 6,009,183 | A | 12/1999 | Taenzer | |
| 6,038,330 | A | 3/2000 | Meucci | |
| 6,064,177 | A | 5/2000 | Dixon | |
| 6,181,801 | B1 | 1/2001 | Puthuff | |
| 6,307,943 | B1 | 10/2001 | Yamagishi | |
| 6,349,001 | B1 | 2/2002 | Spitzer | |
| 6,580,800 | B1 * | 6/2003 | Yamasaki | H04R 1/105 381/379 |
| 6,681,022 | B1 | 1/2004 | Puthuff | |
| 6,914,997 | B2 | 7/2005 | MacDonald et al. | |
| 7,004,582 | B2 | 2/2006 | Jannard et al. | |
| 7,050,598 | B1 | 5/2006 | Ham | |
| 7,082,207 | B2 | 7/2006 | Rapps | |
| 7,331,666 | B2 | 2/2008 | Swab et al. | |
| 7,564,988 | B2 | 7/2009 | Azima et al. | |
| 7,876,066 | B2 | 1/2011 | Mori et al. | |
| 7,916,880 | B2 | 3/2011 | Starnes et al. | |
| 7,970,161 | B2 | 6/2011 | Van Halteren | |
| 8,011,783 | B1 | 9/2011 | LeBlang | |
| 8,019,111 | B2 | 9/2011 | Soheili | |
| 8,170,262 | B1 | 5/2012 | Liu | |
| 8,374,375 | B2 | 2/2013 | Hu | |
| 8,437,489 | B2 | 5/2013 | Von Dombrowski et al. | |
| 2003/0174854 | A1 * | 9/2003 | Amae | H04R 1/105 381/379 |
| 2004/0028246 | A1 | 2/2004 | Maekawa | |
| 2004/0033820 | A1 * | 2/2004 | Lewis | H04M 1/05 455/569.1 |
| 2004/0042629 | A1 | 3/2004 | Mellone | |
| 2004/0198470 | A1 | 10/2004 | Dyer et al. | |
| 2005/0025329 | A1 * | 2/2005 | Lee | H04R 1/105 381/370 |
| 2005/0090295 | A1 | 4/2005 | Kamal | |
| 2006/0166705 | A1 | 7/2006 | Seshadri | |
| 2007/0064969 | A1 | 3/2007 | Chou | |
| 2007/0223717 | A1 | 9/2007 | Boersma | |
| 2007/0286446 | A1 | 12/2007 | Yang | |
| 2008/0025539 | A1 | 1/2008 | Bailey | |
| 2008/0107287 | A1 | 5/2008 | Beard | |
| 2008/0219025 | A1 | 9/2008 | Spitzer et al. | |
| 2008/0253604 | A1 | 10/2008 | Yamagishi | |
| 2009/0123000 | A1 | 5/2009 | Wright | |
| 2009/0243553 | A1 | 10/2009 | Walley | |
| 2010/0142719 | A1 | 6/2010 | Chiba | |
| 2010/0183182 | A1 | 7/2010 | Grandt | |
| 2010/0215198 | A1 | 8/2010 | Ngia | |
| 2010/0231161 | A1 | 9/2010 | Brown | |
| 2010/0320961 | A1 | 12/2010 | Castillo et al. | |
| 2011/0140652 | A1 | 6/2011 | Chandran | |
| 2011/0255723 | A1 | 10/2011 | Obradovic | |
| 2011/0286615 | A1 | 11/2011 | Olodort | |
| 2012/0043937 | A1 | 2/2012 | Williams | |
| 2012/0134524 | A1 | 5/2012 | Peng | |
| 2012/0237075 | A1 | 9/2012 | East et al. | |
| 2012/0243723 | A1 | 9/2012 | Halkosaari et al. | |
| 2012/0288133 | A1 | 11/2012 | Nokuo | |
| 2013/0043827 | A1 | 2/2013 | Weinstein et al. | |
| 2013/0051585 | A1 | 2/2013 | Karkkainen | |
| 2013/0136279 | A1 * | 5/2013 | Brown | H04R 1/105 381/151 |
| 2013/0216087 | A1 | 8/2013 | MacDonald | |
| 2013/0251171 | A1 | 9/2013 | Liu | |
| 2013/0342806 | A1 | 12/2013 | Sathe | |
| 2014/0098983 | A1 | 4/2014 | Clow | |
| 2014/0200883 | A1 | 7/2014 | Usher | |
| 2014/0270316 | A1 | 9/2014 | Fan | |
| 2016/0134141 | A1 | 5/2016 | Jentz et al. | |
| 2016/0134958 | A1 | 5/2016 | Thompson et al. | |

FOREIGN PATENT DOCUMENTS

| | | | |
|---|---|---|---|
| GB | 1591712 | | 6/1981 |
| JP | H03117999 | A | 5/1991 |
| WO | 199711573 | A1 | 3/1997 |
| WO | 2003096745 | A1 | 11/2003 |
| WO | 2008145949 | A1 | 12/2008 |
| WO | 2009087147 | A1 | 7/2009 |
| WO | 2010129369 | A2 | 11/2010 |
| WO | 2010140976 | A2 | 12/2010 |

OTHER PUBLICATIONS

"Sports Ear Clip Headphones JVC-HA-EB75," Retrieved on Jun. 13, 2014, Available at: http://av.jvc.com/product.jsp?modelId=MODL028669.

"Philips Adjustable Earclip Headphones SHS4700/28 (Black)," Published on Dec. 15, 2010, Available at: http://www.amazon.com/Philips-Adjustable-Headphones-SHS4700-28/dp/B003DKL57G.

"Sony Active Style MDR-AS40EX ($40)," Published on Dec. 6, 2011, Available at: http://www.goodhousekeeping.com/product-reviews/electronics-computers/headphone-reviews/best-earclip-headphones#slide-1.

"Polk Audio Ultrafit 500," Retrieved on Jun. 13, 2014, Available at: http://www.headphone.com/collections/clip-on-headphones/products/polk-audio-ultrafit-500.

Zolfagharifard, Ellie ., "At last, an end to Apple's uncomfortable earbuds! Designers launch £6.47 'Sprng clips' that claim to fix the EarPod flaw," Published on Aug. 7, 2013, Available at: http://www.dailymail.co.uk/sciencetech/article-2386195/Apple-Sprng-clips-New-earbuds-iPhones-iPods-fix-design-flaw.html.

U.S. Appl. No. 14/536,564, Jentz et al., "Charger for Group of Devices," filed Nov. 7, 2014.

U.S. Appl. No. 14/536,557, Thompson et al., "Sound Transmission Systems and Devices Having Earpieces," filed Nov. 7, 2014.

"Final Office Action Issued in U.S. Appl. No. 13/734,825", dated Jan. 15, 2015, 9 Pages.

"Final Office Action Issued in U.S. Appl. No. 13/734,825", dated Nov. 20, 2015, 12 Pages.

Ballas, "Theory of the Static Behavior of Piezoelectric Beam Bending Actuator", Retrieved From: http://www.springer.com/978-3-540-32641-0, dated Feb. 2007, 16 Pages.

"Non-Final Office Action Issued in U.S. Appl. No. 13/734,825", dated Jun. 5, 2015, 11 Pages.

"Non-Final Office Action Issued in U.S. Appl. No. 13/734,825", dated Jun. 5, 2014, 8 Pages.

Grossard, et al."Mechanical and Control-Oriented Design of a Monolithic Piezoelectric Microgripper Using a New Topological Optimization Method", In the Proceedings of IEEE Transactions on Mechatronics, Feb. 2009, pp. 32-45.

International Search Report & Written Opinion issued in PCT Application No. PCT/US2015/058697, dated Jan. 5, 2016, 14 pages.

Second Written Opinion issued in PCT Application No. PCT/US2015/058697, dated May 24, 2016, 5 pages.

Piejko, Pawel, "Innergie Magic Cable Trio Integrates USB and Apple Tips in a Single Cord," 2 pages, published on Dec. 14, 2011, available at http://www.gizmag.com/innergie-magic-cable-trio/208501, accessed May 27, 2018, 2 pages.

(56) References Cited

OTHER PUBLICATIONS iPhoneness, "7 Super Chargers: Charge Multiple iPads / iPhones at the Same Time," published Sep. 3, 2012, available at: http://www.iphoneness.com/iphone-accessories/super-chargers-charge-multiple-ipads-iphones-at-the-same-time/#, accessed Mar. 27, 2018, 3 pages.
MobileFun, "4-in-1 Charge and Sync (Apple devices, Galaxy Tab, Micro USB)—Black," published May 2, 2014, available at: http://in.mobilefun.com/39555-4-in-1-charge-and-sync-apple-devices-galaxy-tab-micro-usb-black.htm, accessed Mar. 27, 2018.
Brandon, John, "4 Wireless Charging Pads," published on Dec. 10, 2010, available at http://www.inc.com/magazine/201 01201 /four-wireless-charging-pads.html, accessed Mar. 27, 2018, 2 pages.
Hallenbeck, et al., "Thin-Tube and Receiver-in-Canal Devices: There is Positive Feedback on Both!," In Proceedings of the Hearing Journal, vol. 61, No. 1, Jan. 2008, pp. 28-34.
"Second Written Opinion issued in PCT Application No. PCT/US2015/058698", dated Sep. 30, 2016, 5 pages.
"International Preliminary Report on Patentability Issued in PCT Application No. PCT/US2015/058698", dated Feb. 15, 2017, 6 pages.
Sathe et al., U.S. Appl. No. 13/530,843, "Piezo Beam Device," filed Jun. 22, 2012, 27 pages.
"International Search Report & Written Opinion Issued in PCT Application No. PCT/US2015/058698," dated Feb. 3, 2016, 9 pages.
Samsung, "Multiple Charging Option," published on Feb. 27, 2014, http://www.samsung.com/us/mobile/cell-phones-accessories/APCBU10BBEBSTD, accessed Mar. 27, 2018, via Wayback Machine (https://web.archive.org/web/20130101000000*/http://www.getaddictedto.com/a-charging-haven-in-a-world-of-accessories/), 2 pages.
Malakul, Ploi, "A Charging Haven in a World of Accessories," published on Dec. 20, 2011, available at http://www.getaddictedto.com/a-charging-haven-in-a-world-of-accessories/#sthash.MvxggXQS.dpbs, Feb. 5, 2012, version accessed Mar. 27, 2018, via Wayback Machine (https://web.archive.org/web/20120205113647/http://www.getaddictedto.com/a-charging-haven-in-a-world-of-accessories/), 2 pages.
Sathe et al., U.S. Appl. No. 13/734,825, "Piezo Beam Device," filed Jun. 22, 2012, 27 pages.
"Non-Final Office Action Issued in U.S. Appl. No. 14/536,564", dated Nov. 1, 2016, 7 pages.
"Non-Final Office Action Issued in U.S. Appl. No. 14/536,557", dated Nov. 3, 2017, 15 pages.
"Final Office Action Issued in U.S. Appl. No. 14/536,557", dated Apr. 6, 2017, 17 pages.
"Non-Final Office Action Issued in U.S. Appl. No. 14/536,557", dated Oct. 6, 2016, 16 pages.

* cited by examiner

EARPIECE ATTACHMENT DEVICES

CROSS-REFERENCE TO RELATED APPLICATION(S)

The present application is related to U.S. patent application Ser. No. 14/536,564, entitled "CHARGER FOR GROUP OF DEVICES," filed Nov. 7, 2014, and U.S. patent application Ser. No. 14/536,557, entitled "SOUND TRANSMISSION SYSTEMS AND DEVICES HAVING EARPIECES," filed Nov. 7, 2014, which are incorporated herein by reference in their entirety.

BACKGROUND

Earpieces are devices that can be worn by a user to listen to sound from an audio signal source (e.g., a mobile device, a personal music player, a computer, a tablet) Some earpieces can substantially or completely block an entrance to the ear(s) on which they are worn. In-ear earbuds, for example, may be designed to be at least partially positioned within the ear canal. Over-ear headphones may be designed to be worn over the entire outer portion of the ear (i.e., the pinna). These so-called occluding earpieces can attenuate sounds coming from around a user.

DETAILED DESCRIPTION

Figure 1A:
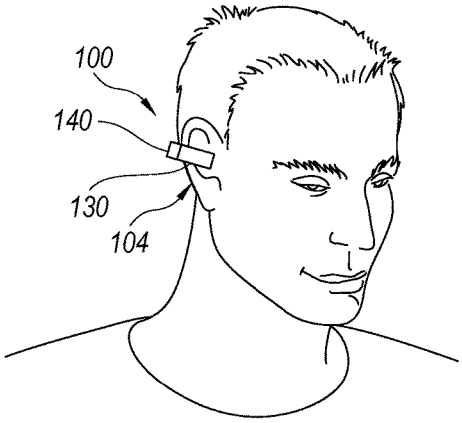
FIG. 1A is a partially schematic isometric side view of an earpiece attached adjacent a user's ear configured in accordance with an embodiment of the disclosed technology.

The present disclosure describes various devices, systems, and methods of attaching one or more earpieces to a user. In some embodiments, for example, an earpiece includes a housing having a proximal end portion, a distal end portion and a projection extending from the housing. A transducer is positioned at the proximal portion of the housing, and a retention member is elastically coupled to the distal portion of the housing. The retention member and the projection are configured to compress a portion of the user's ear therebetween in a manner that positions the proximal end portion of the housing in a vestibule (e.g., the cavum conchae 105*m* discussed below in reference to FIG. 1C) of the ear adjacent an entrance to the auditory canal of the user's ear when the earpiece is attached to the user's ear. In some aspects, the retention member is configured to engage a rear portion of the concha of the user's ear, and projection is configured to engage a surface between the antihelix and the concha of the user's ear. In some aspects, the housing includes a first surface opposite a second surface. The transducer is positioned adjacent the first surface, and the projection extends from the first surface toward the retention member, and a microphone is positioned, for example, adjacent the second surface. In some aspects, for example, the retention member includes a battery electrically coupled to the transducer. In some aspects, the retention member comprises a spring, a bistable mechanism, and/or a deformable material. In some aspects, the earpiece is configured to be attached interchangeably to either the user's left ear or right ear.

In some embodiments, a listening device (e.g., an earpiece) is removably attachable to an ear of a user, and includes a first housing having a proximal end portion and a distal end portion. A transducer is positioned at the proximal end portion of the housing, and a second housing is coupled to the distal end portion of the housing. The second housing can be configured, for example, to slidably engage a rear portion of the user's ear to secure the device to the user's ear. When the device is attached to the user's ear, a proximal end portion of the first housing is positioned adjacent to and spaced apart from an opening of the auditory canal of the user's ear. In some aspects, the second housing is rotatably coupled, for example, to the distal end portion of the first housing. In some aspects, the proximal end portion of the first housing is rotatably coupled to the distal end portion of the first housing. In some aspects, the proximal end portion of the first housing is rotatably coupled to the distal portion of the housing about a first axis, and the second housing is rotatably coupled to the distal end portion of the first housing about a second axis. In certain aspects, the first axis is orthogonal to the second axis. In some aspects, the first axis and the second axis are oriented any suitable angle relative to one another. In some aspects, the first housing includes a first surface opposite a second surface. The transducer is positioned, for example, adjacent the first surface of the first housing and one or more microphones are positioned, for example, adjacent the second surface of the first housing. In some aspects, the first housing is configured to be attached to the second housing in a first orientation and at least a second orientation. In the first orientation, the first housing and the second housing are configured to be worn on a first ear of the user. In the second orientation, the first housing and the second housing are configured to be worn on a second ear of the user.

In some embodiments, an earpiece includes a first housing and a second housing. The second housing extends between a proximal end portion and a distal end portion, and a speaker (e.g., a transducer) is positioned at the proximal end portion of the second housing. A compression device couples or otherwise connects the first housing to the distal end portion of the second housing. The compression device can be configured, for example, to compress the first housing toward the second housing to grip a portion of the user's ear therebetween when the earpiece is attached to the user's ear to position the proximal end portion of the second housing in the cavum conchae of the ear and spaced apart from an entrance to the auditory canal of the user's ear. In some aspects, the second housing includes a first surface opposite a second surface. The transducer is positioned, for example, adjacent the first surface and a microphone is positioned, for example, adjacent the second surface. In some aspects, a projection extends from the first housing toward the second housing. In some aspects, the second housing includes a battery, a transmitter, and a receiver, at least one of which may be electrically coupled to the transducer. In some aspects, the compression device includes a spring, a bistable mechanism, and/or an actuatable button. In some aspects, the earpiece is configured to be attached interchangeably to either the user's left ear or right ear.

These and other aspects of the disclosed technology are described in greater detail below. Certain details are set forth in the following description and in FIGS. 1A-7 to provide a thorough understanding of various embodiments of the disclosed technology. Other details describing well-known structures and systems often associated with earpieces and related methods have not been set forth in the following disclosure to avoid unnecessarily obscuring the description of the various embodiments.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1. Many of the details, dimensions, angles and other features shown in the Figures are merely illustrative of particular embodiments of the disclosure. Accordingly, other embodiments can have other details, dimensions, angles, and features without departing from the spirit or scope of the present invention. In addition, those of ordinary skill in the art will appreciate that further embodiments of the invention can be practiced without several of the details described below.

FIG. 1A is an isometric side view of a listening device or an earpiece 100 positioned adjacent a user's ear 104 and configured in accordance with an embodiment of the disclosed technology. The earpiece 100 includes a boom, an enclosure or a housing 130 configured to house or carry a transducer assembly (e.g., one or more audio speakers, an array of audio transducers). A coupling device 140 (e.g., an elastic material, a spring, a deformable elastomeric material, a hinge) couples the housing 130 to a second housing (not shown) configured to engage a rear surface of the user's ear. As explained in further detail below, the housing 130 and the second housing, when worn on the user's ear, can be configured to compress or otherwise a grip a portion of the user's ear therebetween to secure or attach the earpiece 100 to the user's ear 104. In some embodiments, the earpiece 100 can be configured to position the transducer in the cavum conchae (FIG. 1C) adjacent to, but spaced apart from, an opening to the ear canal without blocking or occluding the ear canal. Moreover, in the illustrated embodiment of FIG. 1A, the earpiece 100 is shown attached to the user's right ear. The earpiece 100 is configured, however, to be interchangeably attached to either the user's left ear or right ear.

As those of ordinary skill in the art will appreciate, over-ear headphones and/or in-ear earbuds when worn by the user can block the entrance to the ear canal of the user's ear 104, thereby significantly attenuating sounds emanating from the user's environment. Earphones that completely or substantially block the entrance to the ear canal can reduce the user's ability to localize sounds in the environment. Non-occluding earpieces may include, for example, earpieces that can be worn on or near the user's ear without substantially or completely blocking an entrance to the user's ear. Some users may prefer a non-occluding earpiece having a small, discreet form factor. Earpieces having a small form factor, however, typically have smaller speakers and thus may need to be placed relatively close to the user's ear to facilitate a suitably loud volume level. Moreover, human ears have a large variety of sizes and shapes. Many users therefore may find it difficult to comfortably attach a non-occluding earpiece that positions the speaker close enough to the ear entrance to produce sound with adequately loud volume. The disclosed technology is expected to provide a benefit of positioning the earpiece 100 on the user's ear to allow the user to listen to sounds from the earpiece 100 while also allowing the user to hear a substantial portion of the sounds from his or her environment.

Figure 1B:
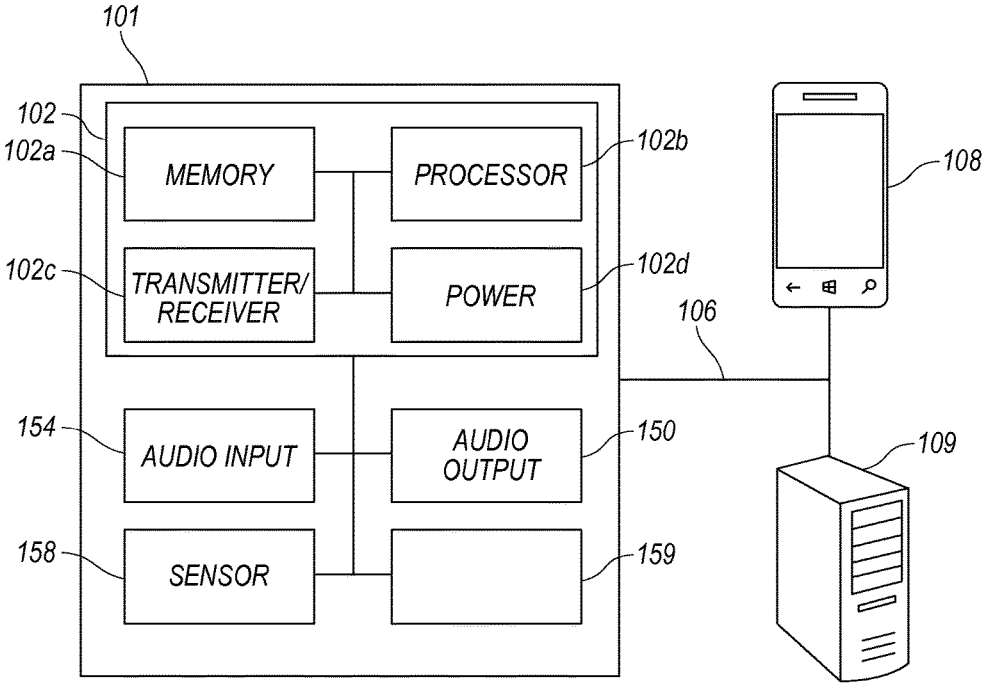
FIG. 1B is a schematic diagram of a system configured in accordance with an embodiment of the disclosed technology.

FIG. 1B and the following discussion provide a brief, general description of a suitable environment in which the technology may be implemented. Although not required, aspects of the technology are described in the general context of computer-executable instructions, such as routines executed by a general-purpose computer. Aspects of the technology can be embodied in a special purpose computer or data processor that is specifically programmed, configured, or constructed to perform one or more of the computer-executable instructions explained in detail herein. Aspects of the technology can also be practiced in distributed computing environments where tasks or modules are performed by remote processing devices, which are linked through a communication network (e.g., a wireless communication network, a wired communication network, a cellular communication network, the Internet, a hospital information network). In a distributed computing environment, program modules may be located in both local and remote memory storage devices.

Computer-implemented instructions, data structures, screen displays, and other data under aspects of the technology may be stored or distributed on computer-readable storage media, including magnetically or optically readable computer disks, as microcode on semiconductor memory, nanotechnology memory, organic or optical memory, or other portable and/or non-transitory data storage media. In some embodiments, aspects of the technology may be distributed over the Internet or over other networks (e.g. a Bluetooth network) on a propagated signal on a propagation medium (e.g., an electromagnetic wave(s), a sound wave) over a period of time, or may be provided on any analog or digital network (packet switched, circuit switched, or other scheme).

FIG. 1B is a schematic diagram of a system 101 configured in accordance with an embodiment of the disclosed technology. A communication link 106 [e.g., a wired communication link and/or a wireless communication link (e.g., Bluetooth, WiFi, infrared and/or another wireless radio transmission network)] communicatively couples the system 101 to a mobile device 108 (e.g., a cellular phone, a smartphone, tablet, a personal digital assistant (PDA), a laptop and/or another suitable portable electronic device) and/or one or more computers 109 (e.g., a local computer, a remote computer, one or more remote servers). In the illustrated embodiment, the system 101 is shown communicatively coupled to the mobile device 108. In some embodiments, however, the system 101 can be communicatively coupled to the one or more computers 109 without the use of the mobile device 108. Moreover, in some embodiments, the system 101 can be implemented with one or more earpieces (e.g., the earpiece 100 of FIG. 1A), and may be configured, for example, to provide an augmented reality experience to a user.

The system 101 includes system electronics 102 coupled to the one or more audio outputs (e.g., one or more speakers, transducer assemblies), one or more audio inputs 117 (e.g., one or more microphones), one or more sensors 118*a* (e.g., one or more accelerometers, thermometers, hygrometers, blood pressure sensors, altimeters, gyroscopes, magnetometers, proximity sensors, barometers, hall effect sensors), and one or more optional components 159 (e.g., one or more digital signal processors, GPS receivers). In some embodiments, the system 101 can comprise a single System on Chip within the earpiece 100 and/or another suitable audio playback device. In some embodiments, for example, the system electronics is implemented as a component in an earpiece separate from the one or more audio outputs 150, the one or more audio inputs 154, the one or more sensors 158, and/or the one or more optional components 159. Moreover, in some embodiments, the one or more audio outputs 150 can include a transducer configured to radiate in wideband range of frequencies (e.g., between about 20 Hertz (Hz) and about 20 kilohertz (kHz), between about 80 Hz and about 14 kHz, between about 50 Hz and about 7 kHz, between about 300 Hz and about 8 kHz, and/or between about 300 Hz and 3.4 kHz). In some embodiments, the one or more audio outputs 150 can comprise any suitable audio transducer (e.g., an electroacoustic loudspeaker, a piezoelectric transducer, an electrostatic transducer).

The system electronics 102 includes several components including memory 102*a* (e.g., one or more computer readable storage modules, components, devices), one or more processors 102*b*, transmit and receive components 102*c* (e.g., an antenna) and a power supply 102*d* (e.g., one or more batteries). In some embodiments, the system electronics 102 may include additional components not shown in FIG. 1B. The memory 102*a* can be configured to store information (e.g., user information or profiles, environmental data, data collected from one or more sensors, media files) and/or executable instructions that can be executed by one or more processors 102*b*. The transmit and receive components 102*c* can be configured to transmit data (e.g., voice input data from the user) to the mobile device 108, the one or more computers 109 and/or another external device. The transmit and receive components 102*c* can also be configured to receive data (e.g., data containing audio information for playback via the one or more audio outputs 150) from the mobile device 108, the one or more computers 109 and/or another external device. The power supply 102*d* can provide electrical power to components of the system 101 and/or the system electronics 102. The power supply 102*d* can comprises one or more batteries and can be rechargeable via a power cable, inductive charging, and/or another suitable recharging method. Additional information regarding the charging of the system 101 can be found, for example, in applicant's U.S. patent application Ser. No. 14/536,564, entitled "CHARGER FOR GROUP OF DEVICES," filed Nov. 7, 2014, which is incorporated herein by reference in its entirety.

In the illustrated embodiment, the system electronics 102 is implemented with the components 102*a-d* described above. In some embodiments, the system electronics 102 can be implemented, for example, on a single System on Chip (SoC). In certain embodiments, one or more of the components comprising the system electronics may be distributed across several locations and/or platforms. In some embodiments, for example, the transmitter/receiver component 102*c* and the power supply 102*d* may be disposed in and/or on an earpiece (e.g., the earpiece 100 of FIG. 1A) configured to be worn by a user, while the memory 102*a* and the processors 102*b* may be disposed on a mobile device (e.g., the mobile device 108) or a computer (e.g., the one or more computers 109) remote from the earpiece.

Figure 1C:
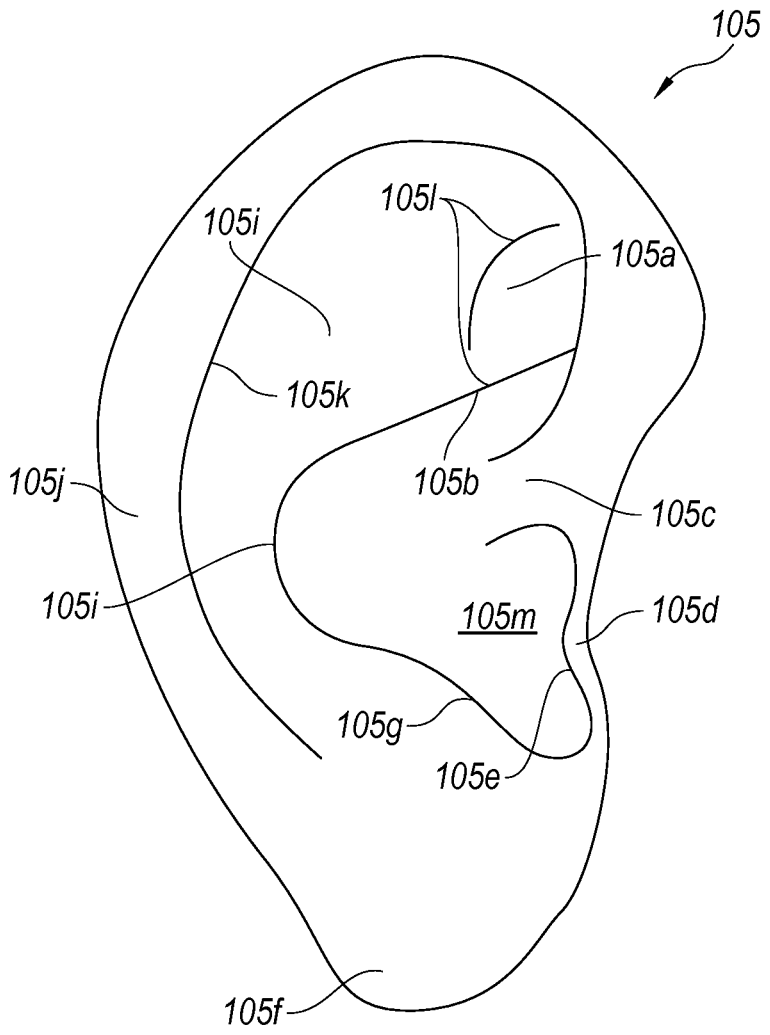
FIG. 1C is a side view of a user's ear.

FIG. 1C is a side view of a pinna 105 of a user's ear. Anatomic structures and features common found on the pinna of human ears are shown in FIG. 1C for the reader's reference. The pinna 105 includes a fossa triangularis 105*a*, a cymba conchae 105*b*, a crux of the helix 105*c*, a tragus 105*d*, an ear canal 105*e*, an ear lobe 105*f*, an antitragus 105*g*, an antihelix 105*i*, a helix 105*j*, a scaphoid fossa 105*k*, a crura of an antihelix 105*l*, and a cavum conchae 105*m* (e.g., an auricular cavity). Additional anatomical structures are not shown for clarity.

As those of ordinary skill in the art will appreciate, non-occluding earpieces can include earpieces worn by a user that do not completely or at least substantially occlude or block an entrance to the ear canal 105*e* of the pinna 105. Embodiments of the present technology may include earpieces (e.g., the earpiece 100 of FIG. 1A) that extend toward the ear canal 105*e*, but do not block an entrance thereto. In some embodiments, the earpieces may have a transducer enclosure (e.g., the housing 130 of FIG. 1A) may have end portions that extend at least partially into the cavum conchae 105*m*. As those of ordinary skill in the art will also appreciate, the cavum conchae 105*m* can comprise a space defined by the antihelix 105*i* that forms a vestibule leading into the ear canal 105*e*. An earpiece (e.g., the earpiece 100 of FIG. 1A) having an enclosure that extends into the cavum conchae 105*m* without substantially blocking the ear canal 105*e* can provide a sound path via a transducer into the user's ear while also allowing the user to perceive sounds from his or her environment.

Figure 2A:
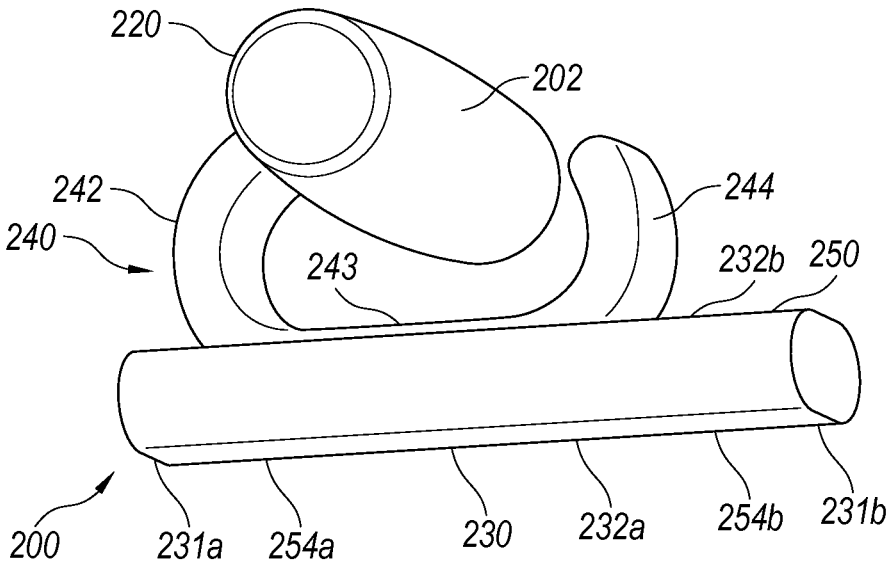
FIG. 2A is a top view of an enclosure of an earpiece configured in accordance with an embodiment of the disclosed technology.

FIG. 2A is a top view of an earpiece 200 configured in accordance with embodiments of the disclosed technology. The earpiece 200 includes a first housing 220, a transducer enclosure or a second housing 230 coupled to the first housing via a compression device or a coupling device 240 (e.g., a spring, an elastic material, a deformable material, a spring loaded hinge). The first housing 220 includes system electronics 202 (e.g., system electronics 102 of FIG. 1B). The system electronics 202 can include, for example, one or more memory modules, processors, transmitters, receivers, and power sources. The second housing 230 includes a distal end portion 231*a* and a proximal end portion 231*b*. The second housing 230 further includes a first side 232*a* opposite a second side 232*b*. The transducer 250 is disposed on the second side 232*b* at the proximal end portion 231*b* of the second housing. The coupling device 240 includes an elastic member 242 that can include, for example, one or more springs, clamps, or elastomeric materials (e.g., PLA, flexible PLA, silicone, urethane rubber). An intermediate portion 243 couples the elastic member 242 to a cuff, a hook, a finger, a lip or a projection 244. The projection 244 extends outwardly from the second housing 230 toward the first housing 220 and is configured to a grip a portion of the pinna 105 (FIG. 1C) when the user wears the earpiece 200. While FIG. 1C shows the pinna 105 of a user's right ear, the earpiece 200 is configured to be interchangeably worn on either ear.

One or more audio inputs 254 are disposed on the first side 232*a* of the second housing 230. The one or more audio inputs 254 can be configured, for example, to acquire or otherwise measure noise levels emanating from an environment substantially near or surrounding the earpiece 200. In the illustrated embodiment, the one or more audio inputs 254 are identified separately as a first microphone 254*a* and a second microphone 254*b*. In some embodiments, however, the earpiece 200 can include a single audio input 254 or three or more audio inputs 254. Moreover, in other embodiments, the earpiece 200 does not include any audio inputs or microphones.

Figure 2B:
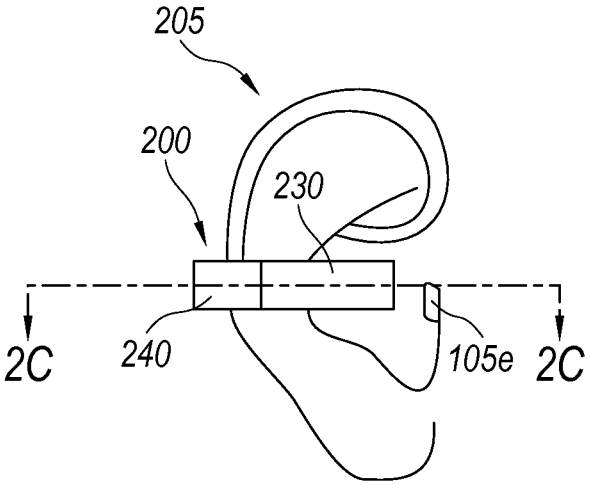
FIG. 2B is a partially schematic side view of the earpiece of FIG. 2A shown attached to a user's ear.
Figure 2C:
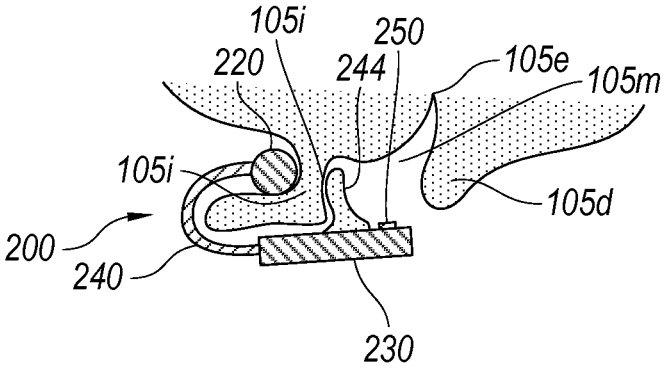
FIG. 2C is a top section view of FIG. 2B.

FIGS. 2B and 2C are schematic side views and top section views of the earpiece 200 shown attached to a user's ear 205. As shown in FIG. 2C, the projection 244 extends from the second housing 230 and engages or otherwise grips a portion of the antihelix 105*i* while the first housing 220 presses or otherwise engages a rear portion of the ear 205, thereby compressing a portion of the user's ear there between. As shown in FIG. 2C, when the earpiece 200 is worn by the user, the transducer 250 is positioned proximate the cavum conchae 105*m* without substantially or significantly blocking the entrance to the ear canal 105*e* thereby allowing the user to hear audio information transmitted from the transducer 250 without substantially blocking or occluding ambient sounds from the user's environment.

Figure 2D:
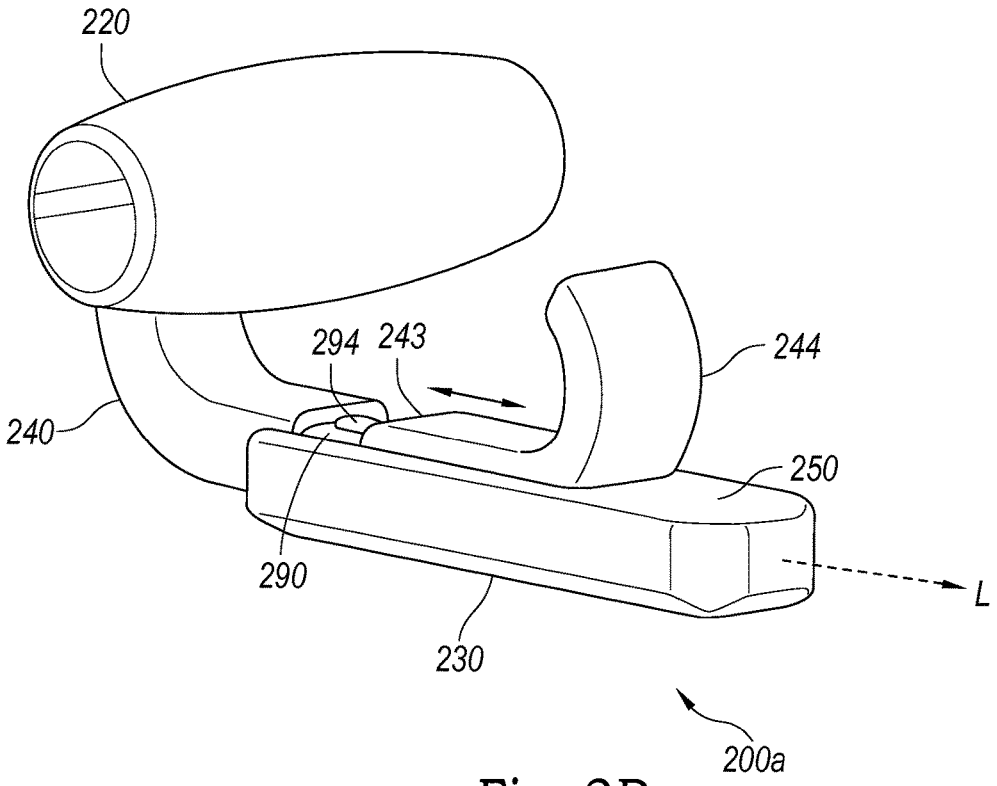
FIG. 2D is a top isometric view of an earpiece configured in accordance with another embodiment of the present technology

FIG. 2D is a top isometric view of an earpiece 200*a* configured in accordance with an embodiment of the present technology. In the embodiment of FIG. 2D, the projection 244, and the intermediate portion 243 are configured to be slidable along the second side 232*b* of the second housing 230 in a direction parallel to a longitudinal axis L of the second housing 230. The intermediate portion 243 and projection 244 are slidably coupled to the second housing 230 via one or more rails 290. A spring 294 provides a restoring force that causes the projection 244 to grip a user's ear (e.g., the user's left ear or right ear) when the earpiece 200*a* is attached thereto.

Figure 3A:
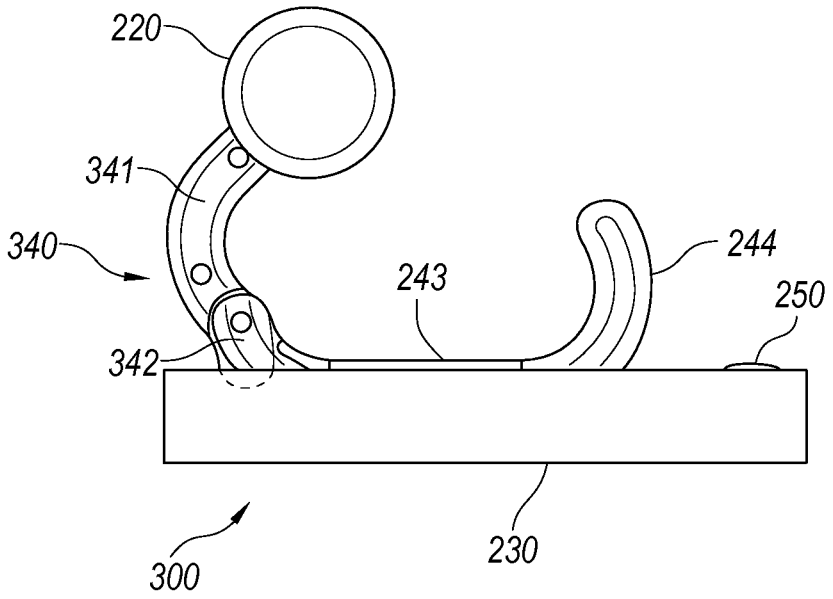
FIG. 3A is a top view of an enclosure of an earpiece configured in accordance with another embodiment of the disclosed technology.
Figure 3B:
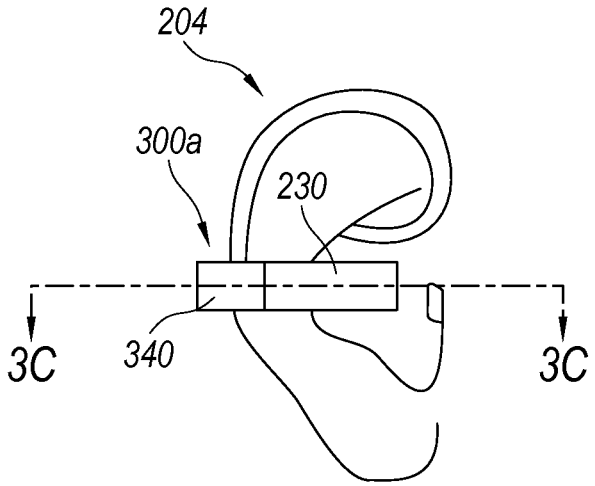
FIG. 3B is a partially schematic side view of the earpiece of FIG. 3A shown attached to a user's ear.
Figure 3C:
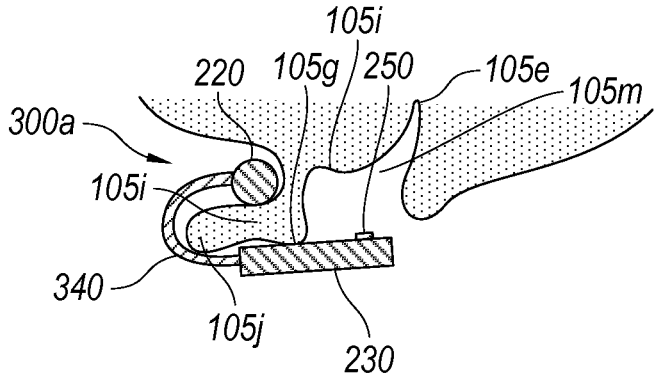
FIG. 3C is a top section view of FIG. 3B.
Figure 3D:
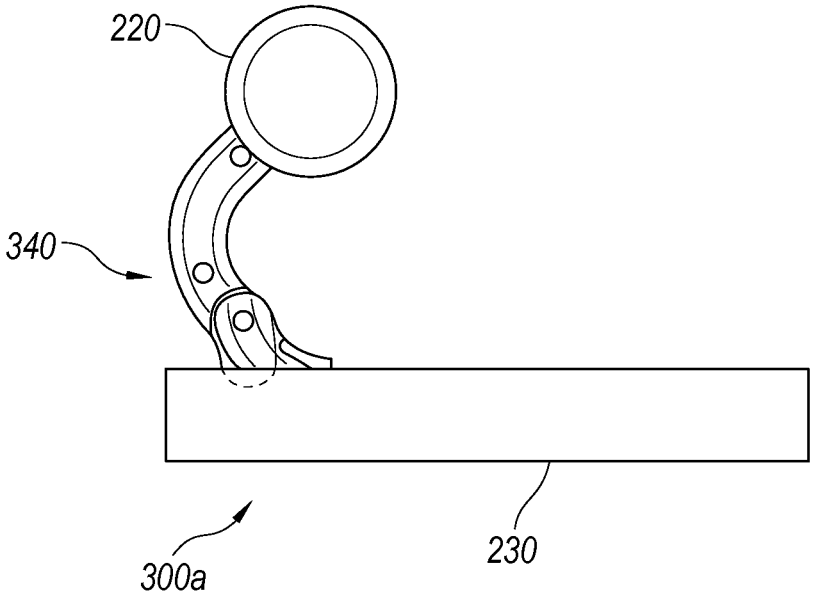
FIG. 3D is a top view of an earpiece configured in accordance with another embodiment of the disclosed technology.

FIG. 3A is a side view of an earpiece 300 configured in accordance with embodiments of the disclosed technology. FIGS. 3B and 3C are schematic side and top views of the earpiece 300. FIG. 3D is a side view of an earpiece 300*a* configured in accordance with another embodiment of the disclose technology. Referring to the FIGS. 3A-3D together, the earpiece 300 includes a compression mechanism 340 (e.g., a spring loaded hinge). The compression mechanism 340 includes an arm 341 attached to the first housing 220 and a spring-loaded pivot mechanism 342 attached to the second housing 230. When attached to a user's ear (e.g., the user's left ear or right ear), the compression mechanism 340 forces the first housing 220 toward the projection 244 extending from the second housing 230 thereby compressing a portion of the user's ear between and securing the earpiece to the user's ear. In some embodiments, as shown in FIG. 3D, the earpiece 300*a* can be implemented without the projection 244.

Figure 4A:
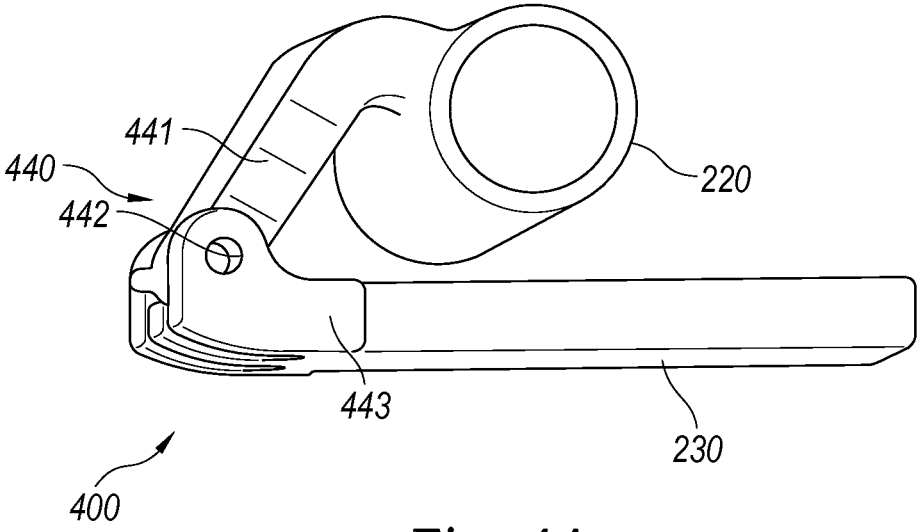
FIG. 4A is a top view of an enclosure of an earpiece configured in accordance with another embodiment of the disclosed technology.
Figure 4B:
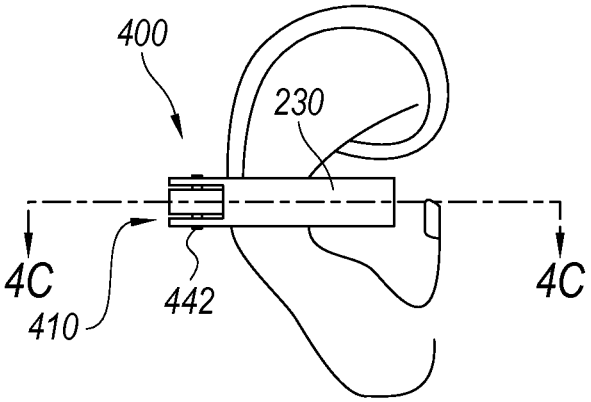
FIG. 4B is a partially schematic side view of the earpiece of FIG. 4A shown attached to a user's ear.
Figure 4C:
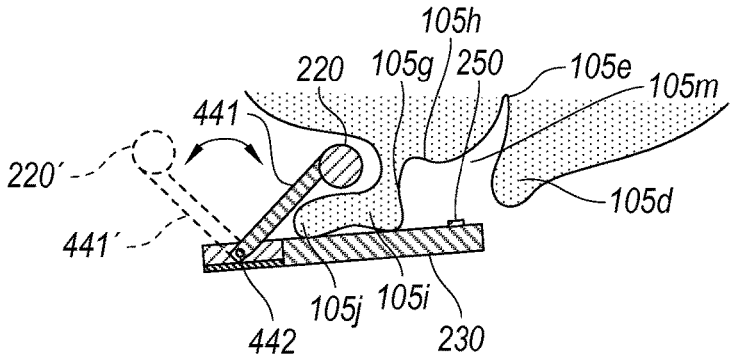
FIG. 4C is a top section view of FIG. 4B.
Figure 4D:
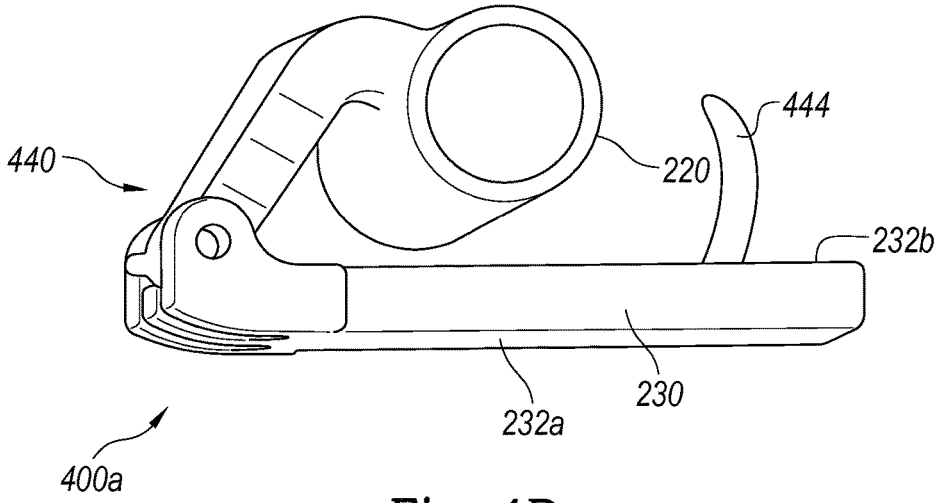
FIG. 4D is a top view of an enclosure of an earpiece configured in accordance with another embodiment of the disclosed technology.

FIG. 4A is a top isometric view of an earpiece 400 configured in accordance with embodiments of the present technology. FIGS. 4B and 4C are schematic side and top views, respectively, of the earpiece 400. FIG. 4D is a side view of an earpiece 400*a* configured in accordance with another embodiment of the disclosed technology. Referring to FIGS. 4A-4D together, the earpiece 400 includes a compression mechanism 440 which can be configured, for example, as a bi-stable spring mechanism. The compression mechanism 440 includes an arm 441 attached to the first housing 220. A hinge 442 couples the arm 441 to a base portion 443 of the second housing 230.

As shown in FIG. 4C, the compression mechanism 440 alternates between a first position and a second position or an open position and a closed position. In the first position indicated by housing 220' and an arm 441', the earpiece 400 is not applying any compressional force against the rear of a user's ear (e.g., the user's left ear or right ear). At the second position, as shown by the first housing 220 and the arm 441, the first housing 220 compresses a portion of the user's ear between the first housing 220 and the second housing 230, thereby positioning the transducer 250 in the or near the cavum conchae 105*m*. In some embodiments, such as the illustrated embodiment of FIG. 4D, the earpiece 400*a* can include a projection 444 that extends from the second housing 230 and is configured to grip a portion of the front of a user's ear (e.g., the user's left ear or right ear), thereby further securing the earpiece 400*a* to the user's ear.

Figure 5A:
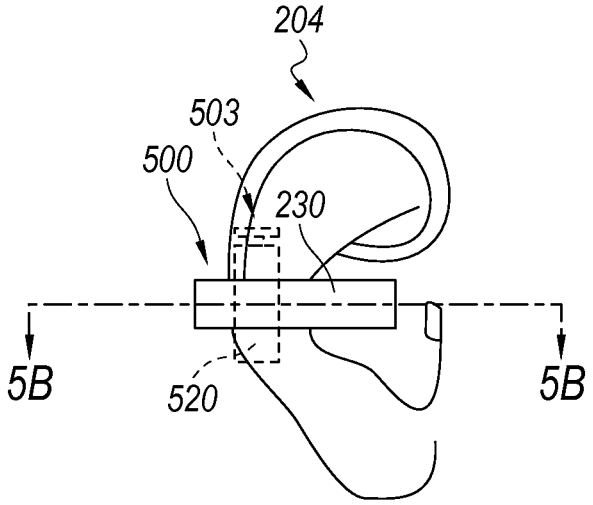
FIG. 5A is a partially schematic side view of an earpiece configured in accordance with another embodiment of the disclosed technology.
Figure 5B:
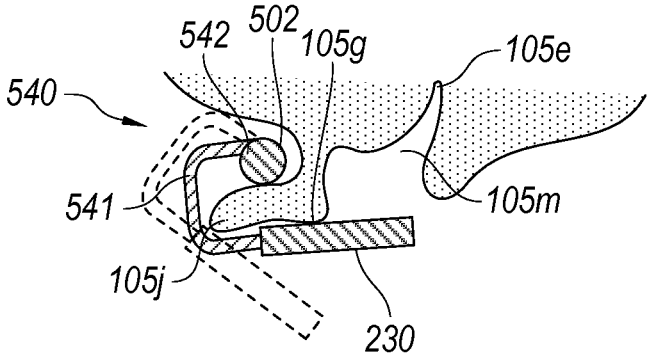
FIG. 5B is a top section view of FIG. 5A.

FIGS. 5A and 5B are side and top schematic views of an earpiece 500 configured in accordance with an embodiment of the disclosed technology. The earpiece 500 includes a first housing 520 having an actuator or an actuatable button 503. Actuation of the button 503 unlocks a hinge 542 thereby allowing an arm 541 to swing freely away from a rear portion of a user's ear (e.g., the user's left ear or right ear). To attach the earpiece 500 to an ear, the users actuates the button 502 and moves the arm 541 until the first housing 520 engages a rear portion of the ear, and the first housing 520 and the second housing 230 are compressing a portion of the ear therebetween. The user can then release the button 502 to secure the earpiece 500 onto the user's ear.

Figure 6A:
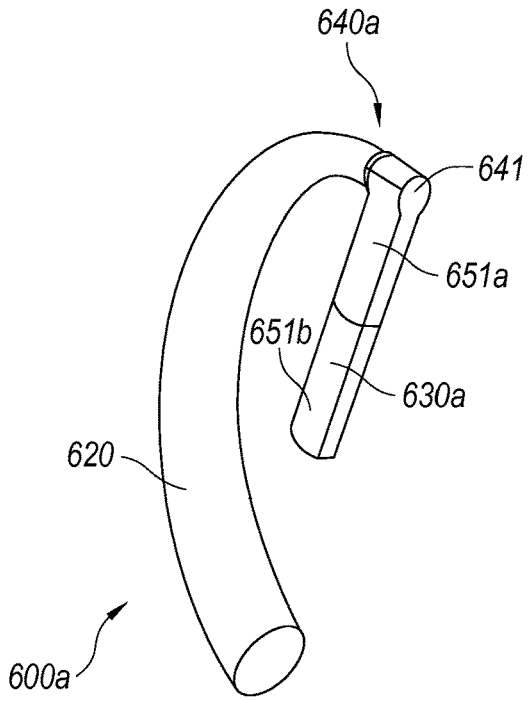
FIGS. 6A and 6B are side isometric views of an earpiece configured in accordance with another embodiment of the disclosed technology.
Figure 6B:
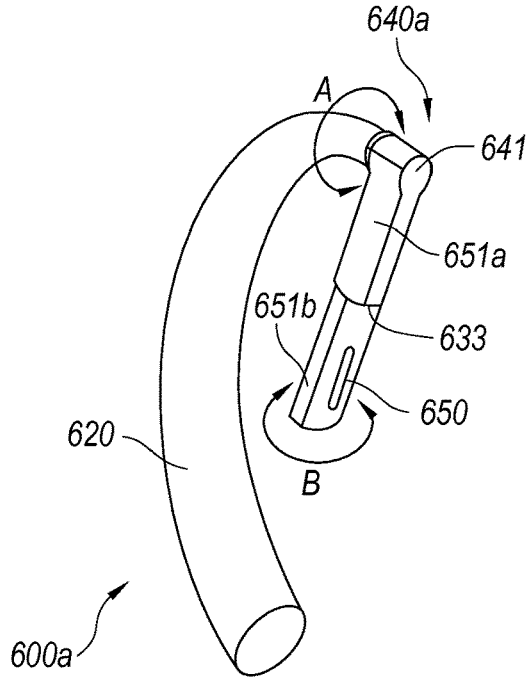

FIGS. 6A and 6B are side isometric views of an earpiece 600*a* configured in accordance with embodiments of the disclosed technology. The earpiece 600*a* includes a housing 620 and a transducer housing or enclosure 630*a*, coupled to the housing 620 by a coupling mechanism 640*a*. The housing 620 is configured to slidably engage a rear portion of user's pinna 105 to secure the earpiece to the user's ear. As shown in FIG. 6B, the transducer enclosure 630 includes a distal end portion 651*a* coupled to a proximal end portion 651*b* via a pivot 633. The pivot 633 allows the proximal end portion 651*b* of the enclosure 630*a* to rotate about an axis in a direction shown by arrow B, thereby allowing the user to wear the earpiece 600*a* on either the left ear or the right ear. The coupling mechanism 640*a* further includes a pivot 641 attached to the housing 620 that allows the transducer enclosure 630 to rotate about an axis in a direction shown by arrow A. In one embodiment, for example, the direction shown by arrow A can be orthogonal to the direction shown by arrow B. In some embodiments, the directions shown by arrows A and B can be oriented at any suitable angle. In some embodiments, the housing 620 is fixedly attached to the enclosure 630*a* without the pivot 641. In some embodiments, the enclosure 630*a* can extend between the distal end portion 651*a* and the proximal end portion 651*b* without the pivot 633.

Figure 6C:
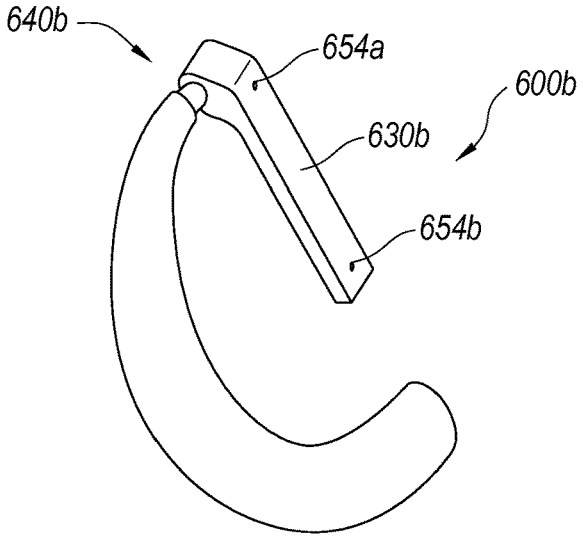
FIGS. 6C and 6D are side isometric views of an earpiece configured in accordance with another embodiment of the disclosed technology.
Figure 6D:
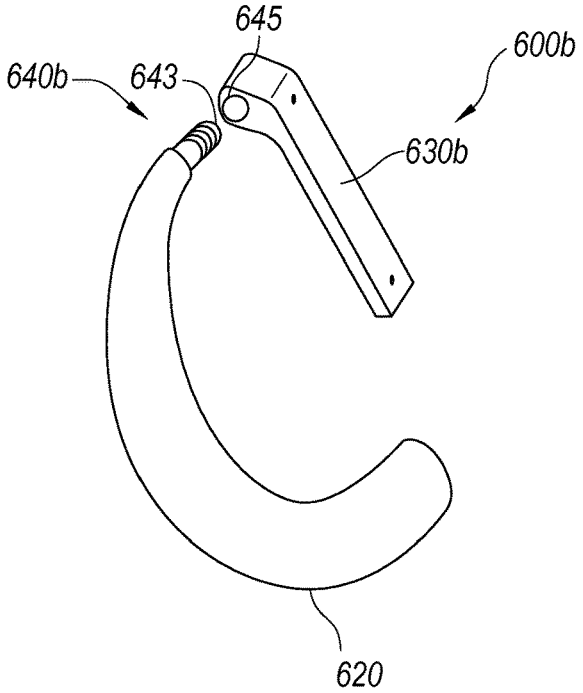

FIGS. 6C and 6D are side isometric views of an earpiece 600*b* configured in accordance with embodiments of the disclosed technology. The earpiece 600*b* includes an enclosure 630*b* coupled to the housing 620 via a coupling mechanism 640*b*. The enclosure 630*b* includes a first microphone 654*a* and a second microphone 654*b*. The opposite side of the enclosure 630*b* includes a transducer 650 (not shown). The coupling mechanism 640*b* includes a threaded male portion 643 that is configured to be received by a female threaded portion 645, allowing the second housing 630*b* to be removably attached to the housing 620. The removable attachment of the second housing 630*b* to the housing 620 can allow the user to reverse the orientation of the second housing 630*b* relative to the housing 620, thereby allowing the earpiece 600*b* to be worn on either the left ear or the right ear. For example, the second housing 630*b* can be configured to be attached to the housing 620 in a first configuration or orientation to allow the user to wear the earpiece 600*b* on the user's right ear and in a second configuration or orientation to allow the user to wear the earpiece 600*b* on the user's left ear. In some embodiments, however, the second housing 630*b* can be fixedly attached to the housing 620.

Figure 7:
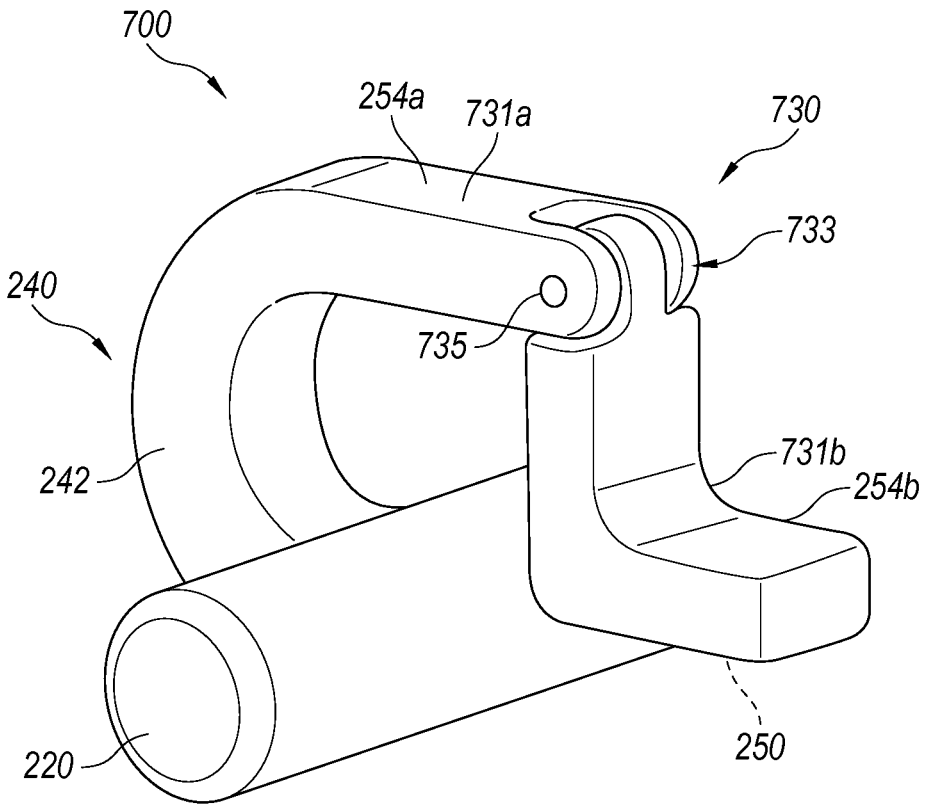
FIG. 7 is a top isometric view of an earpiece configured in accordance with another embodiment of the disclosed technology.

FIG. 7 is a top isometric view of an earpiece 700 configured in accordance with embodiments of the disclosed technology. In the illustrated embodiment of FIG. 7, the earpiece 700 includes a second housing 730 coupled to the first housing 220 (FIG. 2A) via the elastic member 242 of the coupling device 240 (FIG. 2A). The second housing 730 includes a distal end portion 731*a* and a proximal end portion 731*b*. The distal end portion 731*a* is hingedly coupled to the proximal end portion 731*b* via a hinge 733 that includes pivot 735. The hinge 733 of the second housing 730 allows the proximal end portion 731*b* to rotate, thereby allowing the transducer 250 to be placed closer to the ear canal, which may allow for reduced volume and/or power output requirements. In some embodiments, the earpiece 700 is configured to be worn interchangeably on either a user's left ear or right ear.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

We claim:

1. An earpiece removably attachable to an ear of a user, the earpiece comprising:

a housing having a proximal end portion, a distal end portion, and an interior side surface extending therebetween, wherein the interior side surface faces the user's ear when the earpiece is attached to the user's ear;

a transducer positioned at the proximal end portion of the housing;

a retention member elastically coupled to the distal end portion of the housing, wherein the retention member and the housing are configured to compress a portion of the user's ear therebetween in a manner that positions the proximal end portion of the housing in a vestibule of the ear adjacent an entrance to an auditory canal of the user's ear when the earpiece is attached to the user's ear; and a c-shaped projection extending inwardly from the interior side surface of the housing toward the retention member, wherein the projection is configured to contact and grip opposing sides of an antihelix of the user's ear when the earpiece is attached to the user's ear.

2. The earpiece of claim 1 wherein the retention member is further configured to engage a rear portion of a concha of the user's ear.

3. The earpiece of claim 1 wherein the housing further includes an exterior side surface opposite the interior side surface, wherein the transducer is positioned adjacent the interior side surface, and further comprising a microphone positioned adjacent the exterior side surface.

4. The earpiece of claim 1 wherein the retention member includes a battery that is electrically coupled to the transducer.

5. The earpiece of claim 1 wherein the retention member comprises a spring.

6. The earpiece of claim 5 wherein the retention member further comprises a bistable mechanism.

7. The earpiece of claim 1 wherein the retention member comprises a deformable material.

8. An earpiece removably securable to an ear of a user, the earpiece comprising:

a first housing and a second housing, wherein the second housing extends between a proximal end portion and a distal end portion, wherein the second housing includes an interior side surface extending between the proximal and distal end portions, and wherein the interior side surface faces the user's ear when the earpiece is attached thereto;

a speaker positioned at the proximal end portion of the second housing;

a compression device coupling the first housing to the distal end portion of the second housing, wherein the compression device is configured to compress the first housing toward the second housing to grip opposing sides of an antihelix of the user's ear therebetween when the earpiece is attached to the user's ear, thereby positioning the proximal end portion of the second housing in a cavum conchae of the ear and spaced apart from an entrance to an auditory canal of the user's ear; and a c-shaped hook extending inwardly from the interior side surface of the second housing toward the first housing, wherein the hook is configured to engage a portion of the user's ear when the earpiece is attached thereto.

9. The earpiece of claim 8 wherein the second housing further includes an exterior side surface opposite the interior side surface, wherein the speaker is positioned adjacent the interior side surface, and further comprising a microphone positioned the second exterior side surface.

10. The earpiece of claim 8 wherein the second housing includes a battery that is electrically coupled to the speaker.

11. The earpiece of claim 8 wherein the compression device comprises a spring.

12. The earpiece of claim 8 wherein the compression device comprises an actuatable button.

* * * * *